US005674138A

United States Patent [19]

Nolan

[11] Patent Number: 5,674,138

[45] Date of Patent: Oct. 7, 1997

[54] BASEBALL BAT AND PRACTICE DEVICE COMBINATION

[75] Inventor: Timothy J. Nolan, Antioch, Ill.

[73] Assignees: Paul V. Smith, Sr.; Paul V. Smith, Jr., Lombard, Ill.; part interest to each

[21] Appl. No.: 657,653

[22] Filed: Jun. 3, 1996

Related U.S. Application Data

[63] Continuation-in-part of Ser. No. 580,985, Jan. 3, 1996.

[51] Int. Cl.[6] ..... A63B 59/06

[52] U.S. Cl. ..... 473/457; 473/564; 473/566

[58] Field of Search ..... 273/72 R, 72 A, 273/26 B; 473/564–568, 457

[56] References Cited

U.S. PATENT DOCUMENTS

| | | |
|---|---|---|
| 1,026,990 | 5/1912 | Matson . |
| 3,469,839 | 9/1969 | Pietronuto et al. . |
| 3,623,724 | 11/1971 | Lande . |
| 3,971,559 | 7/1976 | Diforte, Jr. . |
| 4,260,150 | 4/1981 | Tabet . |
| 4,555,111 | 11/1985 | Alvarez . |
| 4,634,121 | 1/1987 | Sasaki . |
| 4,671,508 | 6/1987 | Tetreault . |
| 4,768,785 | 9/1988 | Patterson . |
| 4,844,460 | 7/1989 | Mitchell et al. . |
| 4,989,386 | 2/1991 | Anderson . |
| 5,050,877 | 9/1991 | Wales . |
| 5,277,421 | 1/1994 | Rewolinski . |

*Primary Examiner*—Mark S. Graham
*Attorney, Agent, or Firm*—Meroni & Meroni

[57] ABSTRACT

A baseball bat is provided which sized and configured for use in a baseball game by itself and in combination with a practice device for use in training. The baseball bat has a knob end disposed at one end of the bat adjacent to a cylindrically shaped handle portion of the bat. The knob end has a socket hole in axial alignment with the bat. The practice device including a weight structure having a weight sized for positioning in coaxial engagement with the knob end of the baseball bat. The weight has a mass in the range of one to forty-eight ounces. The weight structure has a connecting structure projecting outwardly from the weight structure for disengageable connection within the socket hole to secure the practice device in fixed position with the knob end of the baseball bat for use in training.

14 Claims, 6 Drawing Sheets

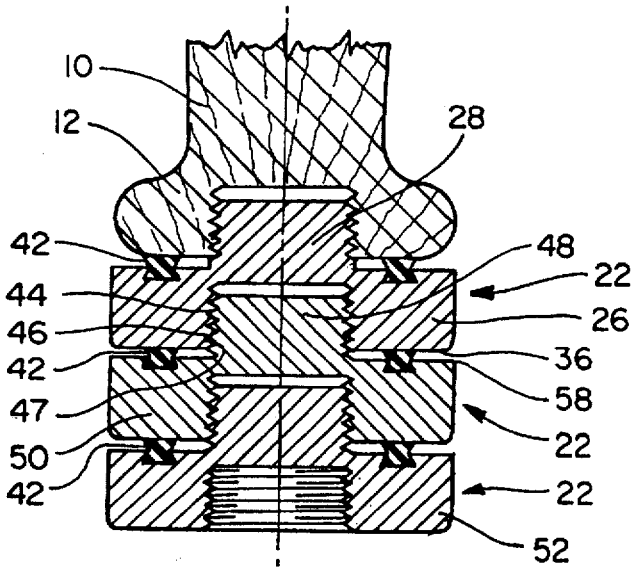
Fig. 4
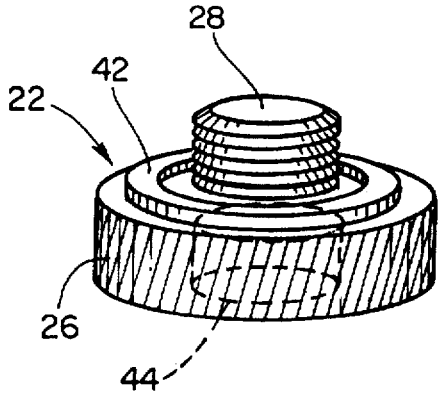
Fig. 5
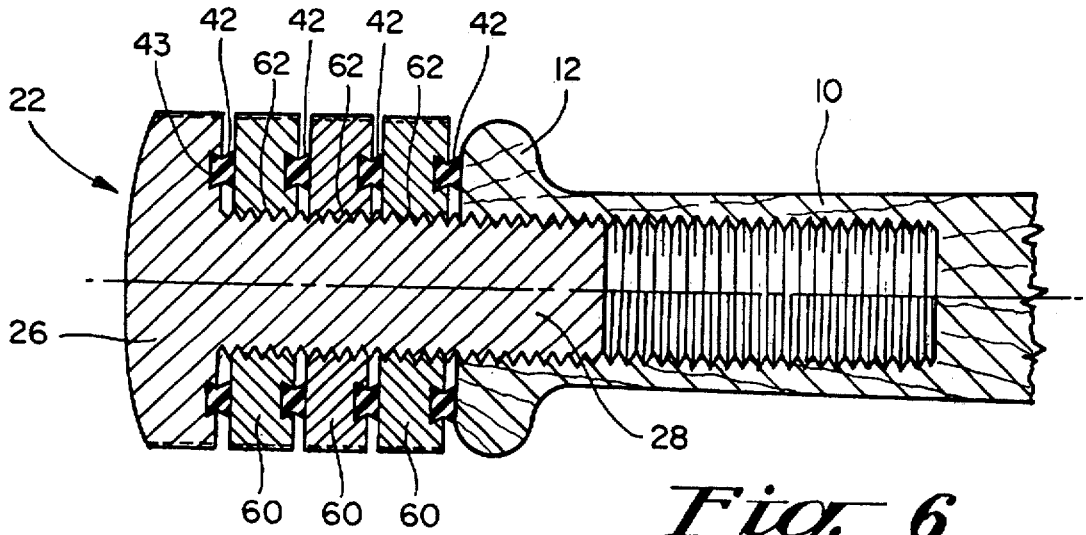
Fig. 6
Fig. 7
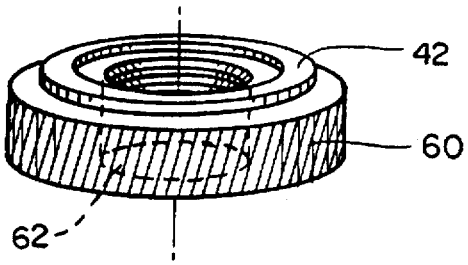

BASEBALL BAT AND PRACTICE DEVICE COMBINATION

This application is a CIP of Ser. No. 08/580,485, filed Jan. 3, 1996, pending.

BACKGROUND OF THE INVENTION

1. Field of the Invention

The present invention relates generally to baseball bats. More particularly, the present invention relates to a baseball bat adapted for use in combination with a practice device.

2. Description of the Prior Art

It is well known in the sporting world involving the game of baseball that a lot of practice is required for enabling a baseball player to develop a professional type of power swing for driving a baseball at the highest possible velocity, even though, in certain instances it may be desired to alter the swing for, so called, bunts, hits to the opposite field and the like. The present invention is concerned with a baseball batting training device suitable for use in practice by a baseball player to aid in developing a more accurate and powerful swing.

In the past, certain types of weights have been used on a bat, such as metal members or rubber annular rings, to assist a player in warming up before entry into the batter's box. Other attachments to a baseball bat for training purposes have been used to teach a batter how to make a proper swing when trying to hit a ball. Still other types of baseball batting training devices have embodied a permanently modified baseball bat that audibly signals the batter when he or she is swinging the bat properly.

For example, U.S. patent application Ser. No. 1,026,990 issued to Matson discloses a bat having a counterbalancing weight attached at one end. The Matson device utilizes a screw that is permanently secured to the bat and axially projects outward for attachment of the weight thereto. Hence, the Matson device suffers from a problem common to other prior art devices that utilize modified baseball bats in that such devices cannot be used in a baseball or softball game with the weight removed.

As will be described in greater detail hereinafter, the baseball bat and practice device of the present invention solves this problem and differs from those previously proposed and employs a number of novel features that render it highly advantageous over the prior art.

SUMMARY OF THE INVENTION

Accordingly, it is an object of this invention to provide an easily attachable practice device which connects to a baseball bat below the bat handle to produce a desirable leverage to aid a user in developing an improved swing.

Still another object of this invention is to provide a baseball bat and practice device which is inexpensive to manufacture.

To achieve the foregoing and other objectives, and in accordance with the present invention, a baseball bat is provided which sized and configured for use in a baseball game by itself and in combination with a practice device for use in training. The baseball bat has a knob end disposed at one end of the bat adjacent to a cylindrically shaped handle portion of the bat. The knob end has a socket hole in axial alignment with the bat. The practice device including a weight structure having a weight sized for positioning in coaxial engagement with the knob end of the baseball bat. The weight has a mass in the range of one to forty-eight ounces. The weight structure has a connecting structure projecting outwardly from the weight structure for disengageable connection within the socket hole to secure the practice device in fixed position with the knob end of the baseball bat for use in training.

Other objects, features and advantages of the invention will become more readily apparent upon reference to the following description when taken in conjunction with the accompanying drawings, which drawings illustrate several embodiments of the invention.

BRIEF DESCRIPTION OF THE DRAWINGS

FIG. 4 is a sectional view of an alternative embodiment of the baseball practice device having plurality of weight structures that are interconnectable for creating a desired weight;

FIG. 5 is a perspective view of a weight structure of the alternative embodiment of the baseball practice device shown in FIG. 4;

FIG. 6 is a sectional view of an alternative embodiment of the practice device having circular weight tings secured to a bolt of the weight structure;

FIG. 7 is a perspective view of a circular weight ting of the alternative embodiment of the baseball practice device of FIG. 6;

DETAILED DESCRIPTION OF THE PREFERRED EMBODIMENT

Figure 1:
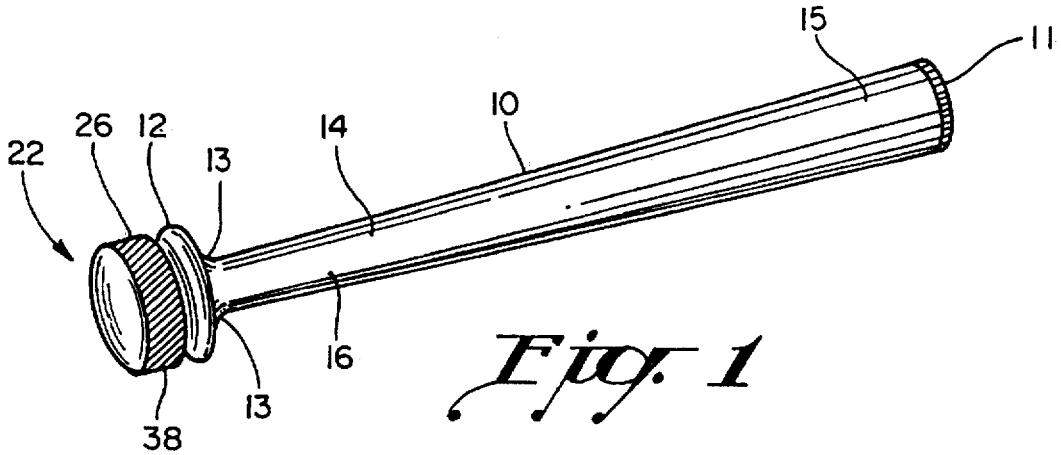
FIG. 1 is a perspective view of my new combination including a baseball bat and a practice device mountable on a knob of the bat.

Referring now to the drawings, a baseball bat 10 is provided and shown in FIG. 1 for use in combination or without a weighted practice device 22.

Figure 2:
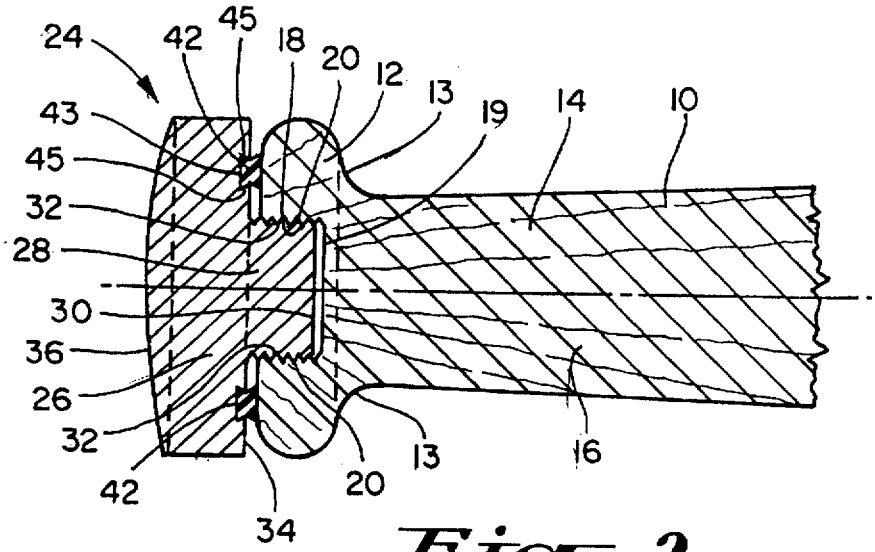
FIG. 2 is an enlarged sectional view of the baseball practice device shown in FIG. 1.

Referring to FIG. 2, the baseball bat 10 has a knob end 12 disposed at one end 14 of the bat 10 adjacent to a cylindrically shaped handle portion 16 of the bat 10. Typically, the knob end 12 is welded to the bat 10 at welds 13. It is common for an aluminum bat 10 to have a plastic end cap 11 attached at end 15 opposite the knob 15, as shown. It should be understood that the welded knob end 12 and plastic end cap 11 are parts of the bat 10, but the bat 10 is still considered to be formed of a single piece or member.

The knob end 12 has a socket hole 18 in axial alignment with the bat 10. The socket hole 18 is close ended having a bottom 19 and internal threads 20. The socket hole 18 and internal threads 20 are formed integral with the knob end 12 of the bat 10, so that the bat may be allowed to conform to official baseball bat regulations and standards when the baseball bat 10 is used by itself without a weighted practice device 22, which is discussed later in greater detail. The bottom 19 of the socket hole 18 is formed by not extending it through the knob end 12 for the express purpose of eliminating the possibility of material being inserted into the socket hole 18. Therefore, during an official baseball game, an umpire can inspect the bat 10 to insure that the bat has not been tampered with.

Figure 8:
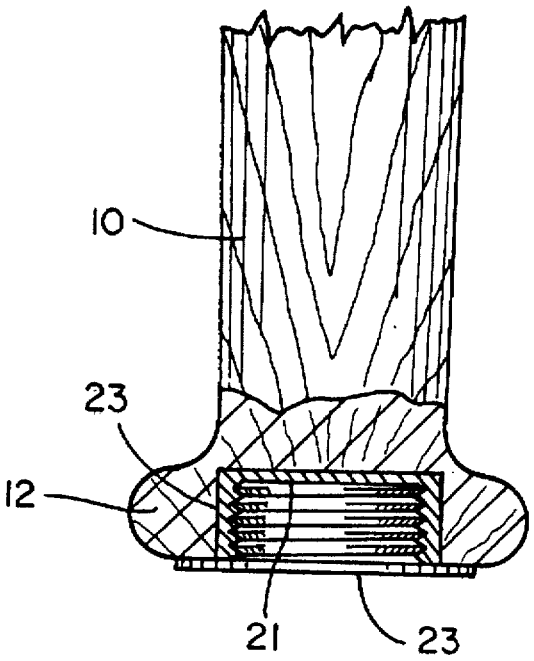
FIG. 8 is a sectional view of the knob end of the bat having a socket insert attached thereto.
Figure 9:
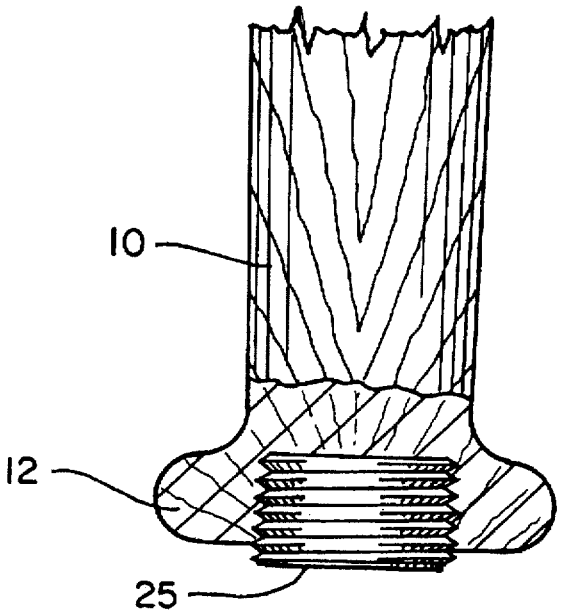
FIG. 9 is a sectional view of the knob end of the bat having a threaded insert.

A typical metal or non-wooden baseball bat is formed of aluminum or graphite. In this event, the internal threads 20 of the bat 10 are subject to damage or excessive wear over continued use due to the fragile nature of such material. Two approaches are presented to solve this problem. Referring to FIG. 8, a cup-shaped socket insert 21 is provided formed of a more durable metal, such as stainless steel. The socket insert 21 is inserted and secured in a socket 23 of the knob end 12 of the bat by welding, brazing, or other conventional methods along a flange 23 of the insert 21. The socket insert 21 then becomes integrated with the knob end 12 and contains the socket hole 18 and internal threads 20. An alternative approach is shown in FIG. 9, where a cylindrical shaped threaded insert 25 is in threaded engagement with the internal threads 20 of the socket hole 18. The insert 25 is generally formed of a stainless steel material and has internal threads for receiving a bolt 28. The use of the insert 25 is especially suited for use with a wooden bat 10. It should be understood that a bat 10 formed of material having internal threads 20 of sufficient strength would not require either approach unless dictated by the bat's construction.

Referring to FIG. 2, the practice device 22 includes a weight structure 24 having a weight 26 sized for positioning in coaxial engagement with the knob end 12 of the baseball bat 10. The weight 26 is of a round circular configuration preferably having a diameter slightly smaller or the same as an outer diameter of the knob end 12 of the baseball bat 10. It is also possible for the weight 26 to have a diameter slightly larger than the outer diameter of the knob end 12, as a further alternative.

Preferably, the weight 26 is formed of material having a density greater than that of the baseball bat. It has been found that brass is preferable over lead because it is easier to machine. The weight structure 24 will typically have mass or weight in the range of one to forty-eight ounces. Excellent results can be obtained where the practice device has a weight of approximately fourteen to eighteen ounces for adult use and eight to twelve ounces for children's use.

The weight structure 24 has a bolt 28 with a bolt end 30 extending outwardly and in axial alignment with the weight 22. The external threads 32 of the bolt are threadingly engageable with the internal threads 20 of the socket hole 18 to secure the practice device 22 in fixed assembly with the knob end 12 of the baseball bat 10, as shown in FIG. 2.

The weight 26 has an upper surface 34, a lower surface 36, and a knurled outer circumferential portion or surface 38. The upper surface may be substantially flat or concave, as desired. The knurled surface 38 aids in providing improved grasping of the weight 26 by a users fingers. A gripping structure is attached to the upper surface 34 for engagement against the knob end 12 of the bat 10 to securely hold the weight 26 in coaxial engagement with the knob end 12 of the baseball bat 10 when the weight 26 is manually rotated to cause the external threads 32 to move axially of the socket hole 18 to tighten the engagement of the weight 26 against the knob end 12. In a preferred embodiment, the gripping structure comprises a circular gasket 42 secured to the upper surface 34 of the weight 26 by engaging a circular recess 43. Preferably, the recess 43 has a pair of inwardly sloping sidewalls 45 for pressingly engaging the gasket 42 to secure the gasket 42 in place.

Figure 3:
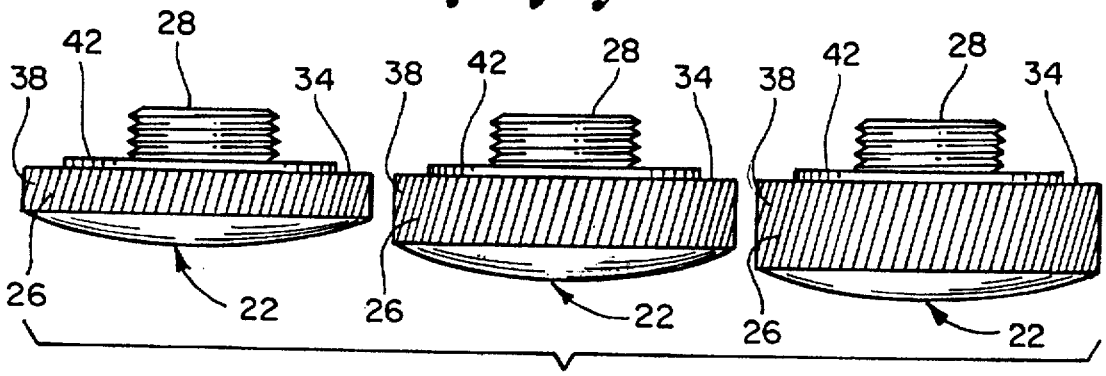
FIG. 3 is an enlarged perspective view of a set of practice devices of a preferred embodiment having a range of weight.

To produce a range of different weights that may be applied to the bat 10, the weight 26 may be formed of varied thickness', as shown in FIG. 3. In an alternative embodiment of the practice device 22, shown in FIGS. 4 and 5, the lower surface 36 of the weight 26 has a second socket hole 44 having internal threads 46 for threaded engagement with external threads 47 of a second bolt 48 connected to a second weight structure 50 for positioning the second weight structure 50 in coaxial engagement with the weight 26. The second weight structure 50 is formed similar to the weight 26 to allow for attachment of yet a third weight structure 52 or additional similarly formed structures, as desired.

A second gripping structure, such as a gasket 42 as previously described, is attached to an upper surface 58 of the second weight structure 50 to securely hold the second weight structure in coaxial engagement with the weight structure 24 when the second weight structure 50 is manually rotated to cause the external threads 47 of the second bolt 48 to move axially of the second socket hole 44 to tighten the engagement of the second weight structure 50 against the weight structure 24. A gasket 42 is similarly attached to the third or additional weight structures.

In an alternative embodiment shown in FIGS. 6 and 7, circular weight rings 60 are provided to selectively increase the mass of the weight structure 24. Each circular weight ring 60 has a threaded bore 62 extending therethrough for threaded engagement with the external threads 32 of the bolt 28. To this extent, the bolt 28 and socket hole 18 would be increased in length and depth to accommodate the addition of one or more circular weight rings 60. A gasket 42 as previously described is secured to the circular weight ring 60 to allow for tightened assembly of the structure.

Figure 10:
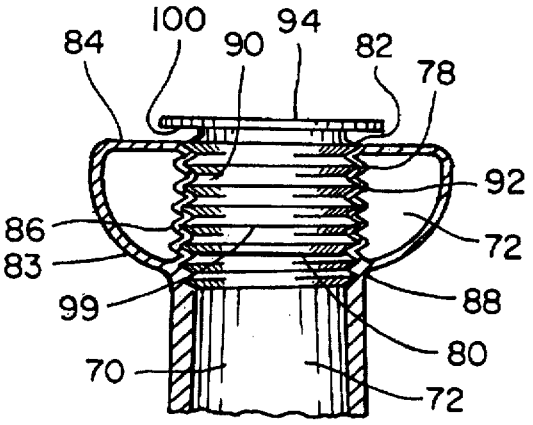
FIG. 10 is a sectional view of one embodiment of a metal type bat for use in combination with the practice device.

Referring now to FIG. 10, a preferred embodiment is illustrated when using a metal type bat 70 for use in combination with the practice device 22 shown in FIGS. 2 and 3. The bat 70 has a knob end 72 disposed at one end 74 of the bat 70 adjacent to a cylindrical shaped handle portion 76 of the bat 70. The knob end 72 contains an axial bore 78 extending therethrough to provide a first opening 80 and a second opening 82 on opposite sides 83, 84 of the knob end.

The knob end 72 includes a cylindrical end portion 86 of the bat that is inserted into the first opening 80 and extends to the second opening 82. The knob end 72 is welded to the bat 70 at welds 88. The interior cylindrical surface 90 of the bat 70 is provided with threads 92 at the end portion 86 for threaded engagement with a metal insert 94.

Figure 11:
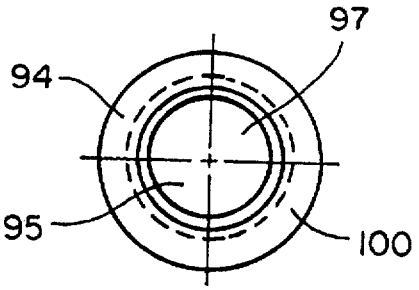
FIG. 11 is an end view of the bat of FIG. 10.
Figure 12:
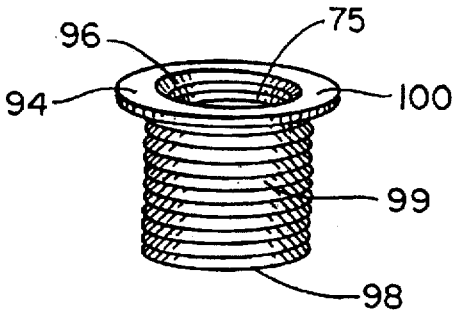
FIG. 12 is a perspective view of the insert for use with the embodiment shown in FIG. 10.

Referring to FIGS. 10–12, the metal insert 94 defines a socket hole 95 having an open top end 97, a closed bottom end 98, and contains internal threads 96 within the socket hole 95 for threaded engagement with the practice device 22 as similarly shown in FIG. 2. The insert 94 contains external threads 99 for threaded engagement with surfaces 92. To secure the insert 94 in fixed assembly with the bat 70, a locktight type of bonding agent of known type may be applied to the threads 92, 99. Further, an outwardly extending flange 100 of the insert 94 may be secured to the knob end 72 to secure the insert 94 in integral assembly with the bat 70.

Figure 13:
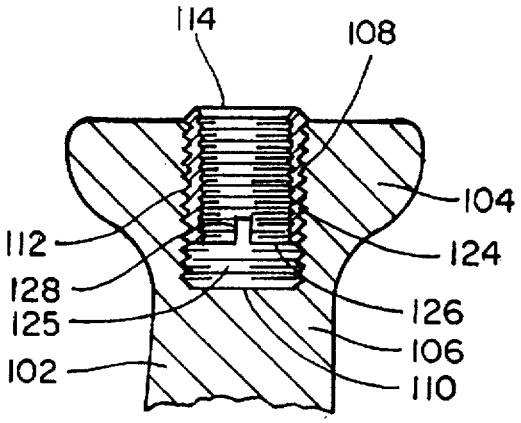
FIG. 13 is a sectional view of one embodiment of a wooden type bat for use in combination with the practice device of FIG. 3.

Referring to FIG. 13, a preferred embodiment is illustrated when using a wood type bat 102 for use in combination with the practice device 22 shown in FIGS. 2 and 3. The bat 102 has a knob end 104 formed integral with the bat 102 at one end 106 of the bat 102. The knob end 104 contains an axial bore 108 drilled therein. The bore 108 is close ended having a bottom 110 and internal threads 112 for threaded engagement with an metal insert 114.

Figure 14:
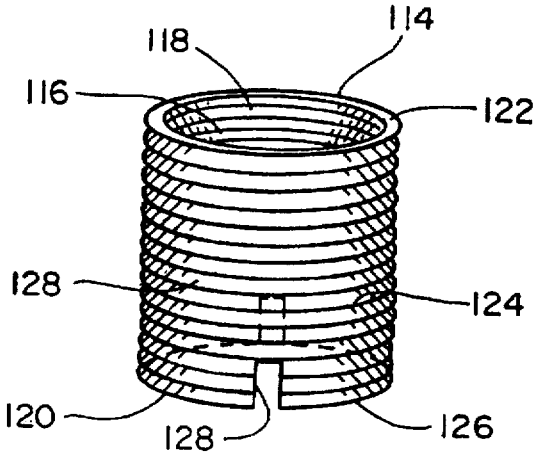
FIG. 14 is a perspective view of the insert for use with the embodiment shown in FIG. 13.

Referring to FIGS. 13 and 14, the metal insert 114 defines a socket hole 116 having an open top end 118, an open bottom end 120, and contains internal threads 122 within the socket hole 116 for thread engagement the practice device 22 as similarly shown in FIG. 2. The insert 114 contains external threads 124 for threaded engagement with threads 112. To secure the insert 114 in fixed assembly with the bat 102, castable epoxy 125 of conventional type is inserted on the bottom 110 of the bore 108 which becomes the bottom of the socket hole 116. When the insert 114 is threadingly engaged in the bore, the edges 126 of the insert 114 extending about the open bottom end 120 will become embedded in the epoxy 125 so that when the epoxy 125 has dried, the insert will become fixedly secured thereto. Additionally, the edges 126 may be provided with indented portions 128 so that the epoxy will be able to fill about these portions 128 to further aid in holding the insert 114 in fixed position when attaching and removing the practice device 22.

Figure 15:
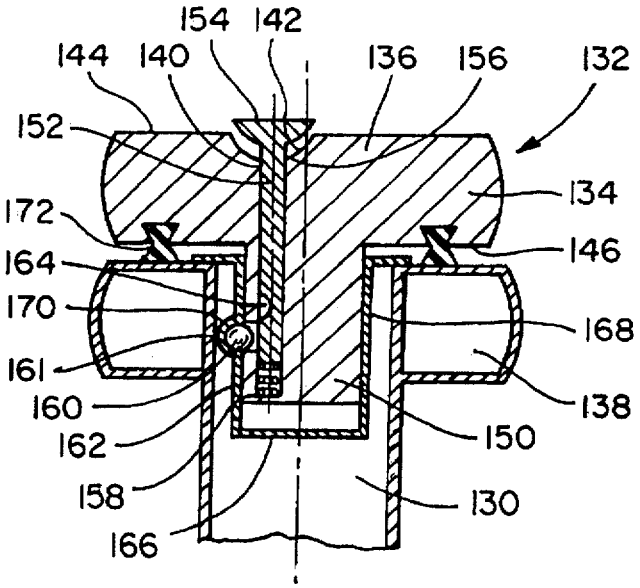
FIG. 15 is a sectional view of an alternative embodiment of the practice device for use in combination with a baseball bat.
Figure 16:
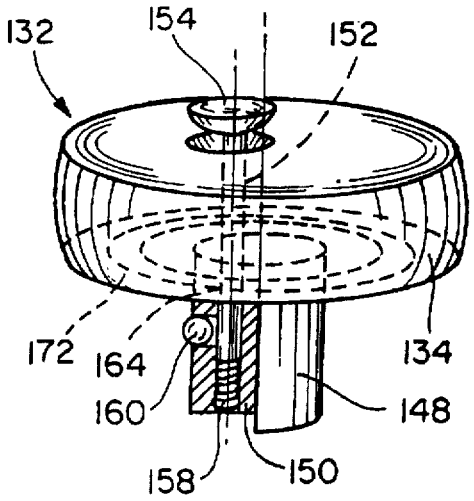
FIG. 16 is a perspective and partially sectional view of the practice device of FIG. 15.
Figure 17:
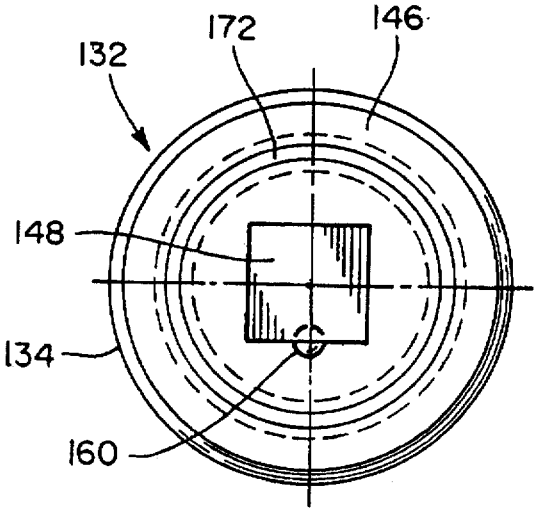
FIG. 17 is a bottom view of the practice device of FIG. 15.

In an alternative embodiment shown in FIGS. 15–18, a bat 130 and practice device 132 have been adapted for quick-release engagement and disengagement with one another. The practice device 132 includes a weight structure 134 having a weight 136 sized for positioning in coaxial engagement with the knob end 138 of the bat 130. The weight structure 134 has an axial bore 140 extending therethough and a recessed portion 142 in axial alignment with the bore 140 on a lower surface 144 of the structure 134. An upper surface 146 of the structure 134 has a connecting structure 148 extending outwardly and in axial alignment with the weight structure 134. The axial bore 140 extends downwardly into the connecting structure 148 to a bottom end 150 of the structure 148. The axial bore 140 is sized and adapted for receiving an actuating lever 152 movably mounted within. A button member 154 is connected to a top end 156 of the lever 152. A spring 158 is secured within the bore 140 for producing outward tension for biasing the lever 152 in an engaging position (FIG. 15).

Figure 18:
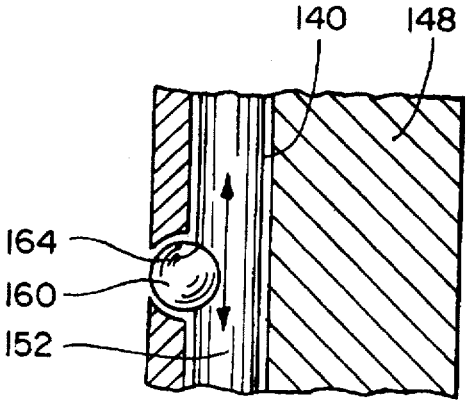
FIG. 18 is a partial sectional view of the practice device of FIG. 15 in disengaging position.
Figure 19:
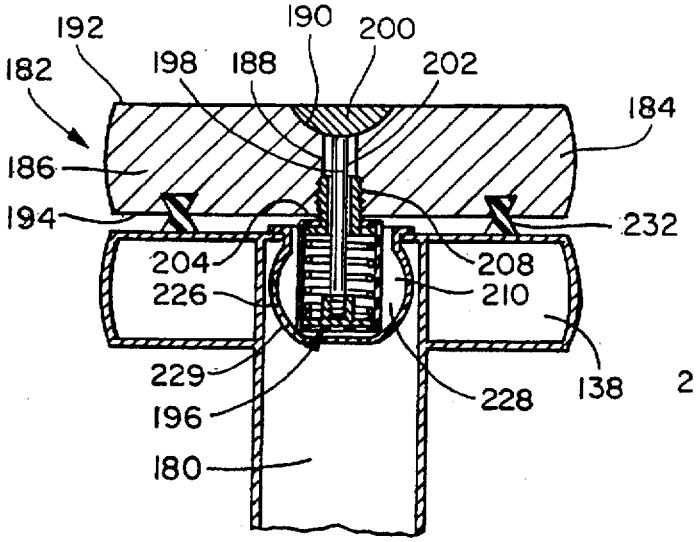
FIG. 19 is a sectional view of an another alternative embodiment of the practice device for use in combination with a baseball bat.
Figure 21:
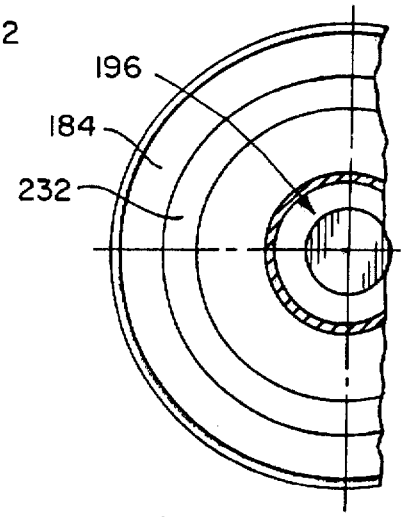
FIG. 21 is a bottom view of the practice device of FIG. 20.
Figure 20:
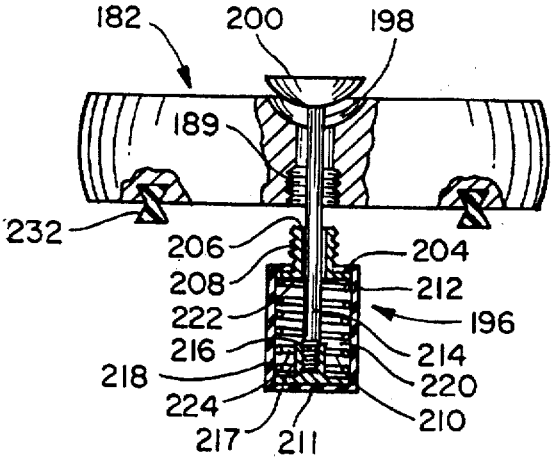
FIG. 20 is a perspective and partially sectional view of the practice device of FIG. 19.
Figure 22:
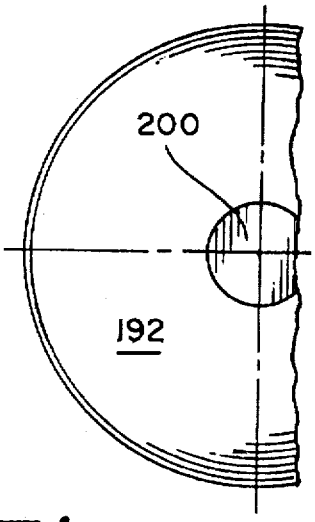
FIG. 22 is a top view of the practice device of FIG. 20.

A bearing or member 160 is secured within the connecting structure 148 so that a portion 161 of the beating 160 is outwardly projected from a side wall 162 of the structure 148 with the lever 152 in pressing engagement against the beating 160 when positioned in the engaging position shown. The beating is movable in a lateral movement perpendicular to a longitudinal axis of the bat. In operation, downward pressure on the button member 154 causes the lever 152 to compress the spring 158 until a recessed portion 164 of the lever 152 is adjacent to the bearing 160 allowing the bearing 160 to move inwardly so that the portion 161 is not outwardly projected and is in a disengaging position, as illustrated in FIG. 18. Releasing the button member 154 will then cause the lever 152 to be upwardly biased with the beating 160 being pressed by the lever 152 back into the engaging position.

The knob end 138 of the bat 130 includes a metal insert 166 secured thereto. The insert 160 includes a socket hole 168 adapted to receive the connecting structure 148. The socket hole 168 includes an outwardly sloped portion 170 adapted for receiving and beating against the outwardly projecting portion 161 of the bearing 160 to secure the connecting structure 148 within the hole 168 until the practice device 132 placed in the disengaging position. A circular gasket 172 is secured to the upper surface 146 of the weight structure 134 as similarly described with gasket 42.

In another alternative embodiment shown in FIGS. 19–22, a bat 180 and practice device 182 have been adapted for quick-release engagement and disengagement with one another. The practice device 182 includes a weight structure 184 having a weight 186 sized for positioning in coaxial engagement with the knob end 188 of the bat 180. The weight structure 184 has an axial bore 188 extending therethough and a recessed portion 190 in axial alignment with the bore 188 on a bottom surface 192 of the structure 184. An upper surface 194 of the structure 184 has a connecting structure 196 extending outwardly and in axial alignment with the weight structure 184. The axial bore 188 is sized and adapted for receiving an actuating lever 198 movably mounted within. A button member 200 is connected to a top end 202 of the lever 198.

The connection structure 196 includes a top annual member 204 having an axial bore 206 for allowing the lever 198 to extend therethough. The member 204 is secured to the weight structure 184 by external threads 208 of the member 204 threadingly engaging internal threads 189 of the bore 188. A flexible rubber cup-shaped housing 210 is connected to the member 204. The housing 210 has an interior chamber 212 therewithin. The lever 198 extends into the chamber 212 with an end portion 214 of the lever 198 having external threads 216 for threaded connection with receiving threads 217 of a bottom annual member 218. A spring 220 is disposed within the chamber 212. A top portion 222 of the spring 220 is connected to the top annual member 204 with a bottom portion 224 of the spring 220 being connected to the bottom annual member 218.

Figure 23:
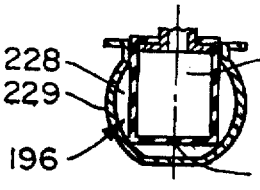
FIG. 23 is a diagrammatic view of the connecting structure of FIG. 19 in a disengaging position.
Figure 24:
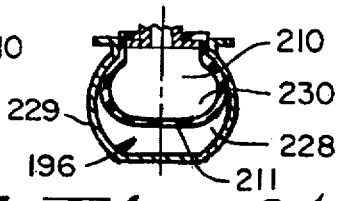
FIG. 24 is a diagrammatic view of the connecting structure of FIG. 19 in an engaging position.

The knob end 188 of the bat 180 includes a metal insert 226 secured thereto. The insert 226 includes a socket hole 228 having outwardly sloped sidewalls 229 adapted to receive the connecting structure 196. At rest in an engaging position (FIG. 24), the spring 220 compresses itself and the rubber housing 210 so that sides 230 of the rubber housing are bulged and projected outward. When inserted in the socket hole 228 of the bat 180, these bulging sides 230 are in pressing engagement with the sloped sidewalls 229 to secure the practice device 182 to the bat 180, as best illustrated in diagrammatic form in FIG. 24. To place the practice device 182 in a disengaging position, downward pressure on the button member 200 causes the lever 198 to expand the spring 220 with the bottom annual member 218 pushing downward on the bottom 211 of the housing 210 causing the housing 210 to become more narrow in an elongated position as it is stretched, as best illustrated in diagrammatic form in FIG. 23, allowing the practice device 182 to be either inserted or removed from the bat 180. A circular gasket 232 is secured to the upper surface 194 of the weight structure 184 as similarly described with gasket 42.

The threaded engagement of the previously defined metal inserts with the bat produces a preferred manner of attachment, however, it should be understood that variations in this manner of construction can be made without departing from spirit and scope of the invention.

Various baseball leagues and associations including softball contain regulations and standards relating to size and shape characteristics of baseball bats. While these regulations and standards can differ with respect to specific weights and measurements, it is common to all such regulations that a baseball bat be formed of a single member or formed in integral assembly as a single member. To this degree, the baseball bats of the various embodiments of the present invention have the possibility of conforming to these regulations and standards for use in an official game when the practice device has been removed.

When the practice device is attached to the bat, the combination can be used during training sessions by a player to aid in improving his or her baseball batting swing, and ultimately aimed towards the end of increasing the velocity of the bat head at the point of impact with the ball. In a typical training procedure, the instructor will observe the player making practice swings, to attempt to instruct the player in proper techniques in the execution of the batting swing. In the course of this training procedure, the instructor may elect to have a ball put on a practice tee, throw the ball vertically upward, or batting practice, and have the player strike the ball with the device on the bat.

The foregoing discussion discloses and describes merely exemplary embodiments of the present invention. One skilled in the art will readily recognize from such discussion, and from the accompanying drawings and claims, that various changes, modifications, and variations can be made without departing from the spirit and scope of the invention as defined in the following claims.

I claim:

1. A baseball bat sized and configured for use in a baseball game by itself and in combination with a practice device for use in training, comprising in combination: the baseball bat having a knob end disposed at one end of the bat adjacent to a cylindrically shaped handle portion of the bat, the knob end having a socket hole in axial alignment with the bat, the practice device including a weight structure having a weight sized for positioning in coaxial engagement with the knob end of the baseball bat, the weight having a mass in the range of one to forty-eight ounces, the weight structure having connecting means projecting outwardly from the weight structure for disengageable connection within the socket hole to secure the practice device in fixed position with the knob end of the baseball bat for use in training, the connecting means including a bolt having external threads in threaded engagement with internal threads of the socket hole, the weight having an upper surface, and gripping means attached to the upper surface for engagement against the knob end of the bat to securely hold the weight in coaxial engagement with the knob end of the baseball bat when the weight is manually rotated to cause the external threads to move axially of the socket hole to tighten the engagement of the weight against the knob end, the knob end including a cylindrical end portion of the bat extending axially therethrough, the end portion having an interior cylindrical surface in fixed engagement with an insert, the insert defining the socket hole.

2. A baseball bat sized and configured for use in a baseball game by itself and in combination with a practice device for use in training, comprising in combination: the baseball bat having a knob end disposed at one end of the bat adjacent to a cylindrically shaped handle portion of the bat, the knob end having a socket hole in axial alignment with the bat, the practice device including a weight structure having a weight sized for positioning in coaxial engagement with the knob end of the baseball bat, the weight having a mass in the range of one to forty-eight ounces, the weight structure having connecting means projecting outwardly from the weight structure for disengageable connection Within the socket hole to secure the practice device in fixed position with the knob end of the baseball bat for use in training, the connecting means including a bolt having external threads in threaded engagement with internal threads of the socket hole, the weight having an upper surface, and gripping means attached to the upper surface for engagement against the knob end of the bat to securely hold the weight in coaxial engagement with the knob end of the baseball bat when the weight is manually rotated to cause the external threads to move axially of the socket hole to tighten the engagement of the weight against the knob end, the knob end being formed of wood and includes a cylindrical metal insert defining the socket hole.

3. A baseball bat sized and configured for use in a baseball game by itself and in combination with a practice device for use in training, comprising in combination: the baseball bat having a knob end disposed at one end of the bat adjacent to a cylindrically shaped handle portion of the bat, the knob end having a socket hole in axial alignment with the bat, the practice device including a weight structure having a weight sized for positioning in coaxial engagement with the knob end of the baseball bat, the weight having a mass in the range of one to forty-eight ounces, the weight structure having connecting means projecting outwardly from the weight structure for disengageable connection within the socket hole to secure the practice device in fixed position with the knob end of the baseball bat for use in training, actuation means operatively connected with the connecting means for controlling engagement of the connecting means with the socket hole, the actuation means including a lever and biasing means for moving the lever.

4. The combination of claim 3, wherein the connecting means includes means for disengageably projecting a member outwardly from a side wall of the connecting means in a lateral movement perpendicular to a longitudinal axis of the bat, the socket hole having an outwardly sloped portion adapted to receive the projected member to secure the practice device in fixed position with the knob end of the bat.

5. The combination of claim 3, wherein the connecting means includes a flexible rubber housing, the housing being stretchable into an elongated position when the lever is manually moved in a disengaging position for inserting and removal of the connecting means in the socket hole, the rubber housing being compressible when the lever is moved by the biasing means in an engaging position causing sides of the housing to bulge outward in pressing engagement with the socket hole to secure the practice device in fixed position with the knob end of the bat.

6. A baseball bat sized and configured for use in a baseball game by itself and in combination with a practice device for use in training, comprising in combination: the baseball bat having a knob end disposed at one end of the bat adjacent to a cylindrically shaped handle portion of the bat, the knob end having a socket hole in axial alignment with the bat, the socket hole having internal threads and a bottom, the practice device including a weight structure having a weight sized for positioning in coaxial engagement with the knob end of the baseball bat, the weight having a mass in the range of one to forty-eight Ounces, the weight structure having a bolt with external threads threadingly engageable with the internal threads of the socket hole to secure the practice device in fixed assembly with the knob end of the baseball bat for use in training, the knob end including a cylindrical end portion of the bat extending axially therethrough, the end portion having an interior cylindrical surface in fixed engagement with an insert, the insert defining the socket hole.

7. The combination of claim 6, wherein the interior cylindrical surface has threads in threaded engagement with external threads of the insert.

8. A baseball bat sized and configured for use in a baseball game by itself and in combination with a practice device for use in training, comprising in combination: the baseball bat having a knob end disposed at one end of the bat adjacent to a cylindrically shaped handle portion of the bat, the knob end having a socket hole in axial alignment with the bat, the socket hole having internal threads and a bottom, the practice device including a weight structure having a weight sized for positioning in coaxial engagement with the knob end of the baseball bat, the weight having a mass in the range of one to forty-eight ounces, the weight structure having a bolt with external threads threadingly engageable with the internal threads of the socket hole to secure the practice device in fixed assembly with the knob end of the baseball bat for use in training, the knob end being formed of wood and includes a cylindrical metal insert defining the socket hole.

9. The combination of claim 8, wherein a bottom of the socket hole has epoxy means applied thereto for securing the insert to the knob end.

10. The combination of claim 9, wherein the insert has external threads in threaded engagement with threads of an axial bore of the knob end, the insert having edges extending about an open bottom end of the insert, the edges having indented portions secured with the epoxy means.

11. A baseball bat sized and configured for use in a baseball game by itself and in combination with a practice device for use in training, comprising in combination: the baseball bat having a knob end disposed at one end of the bat adjacent to a cylindrically shaped handle portion of the bat, the knob end having a socket hole, the practice device including a weight structure having a weight sized for positioning in coaxial engagement with the knob end of the baseball bat, the weight having a mass in the range of one to forty-eight ounces, the weight structure having connecting means projecting outwardly from the weight structure for disengageable connection within the socket hole to secure the practice device in fixed position with the knob end of the baseball bat for use in training, and actuation means operatively connected with the connecting means for controlling engagement of the connecting means with the socket hole, the actuation means including a lever and biasing means for moving the lever.

12. A baseball bat sized and configured for use in a baseball game by itself and in combination with a practice device for use in training, comprising in combination: the baseball bat having a knob end disposed at one end of the bat adjacent to a cylindrically shaped handle portion of the bat, the knob end having a socket hole, the practice device including a weight structure having a weight sized for positioning in coaxial engagement with the knob end of the baseball bat, the weight having a mass in the range of one to forty-eight ounces, the weight structure having connecting means projecting outwardly from the weight structure for disengageable connection within the socket hole to secure the practice device in fixed position with the knob end of the baseball bat for use in training, and actuation means operatively connected with the connecting means for controlling engagement of the connecting means with the socket hole, the connecting means including means for disengageably projecting a member outwardly from a side wall of the connecting means in a lateral movement perpendicular to a longitudinal axis of the bat, the socket hole having an outwardly sloped portion adapted to receive the projected member to secure the practice device in fixed position with the knob end of the bat.

13. The combination of claim 12, wherein the connecting means includes a flexible rubber housing, the housing being stretchable into an elongated position when the lever is manually moved in a disengaging position for inserting and removal of the connecting means in the socket hole, the rubber housing being compressible when the lever is moved by the biasing means in an engaging position causing sides of the housing to bulge outward in pressing engagement with the socket hole to secure the practice device in fixed position with the knob end of the bat.

14. A baseball bat and practice device, comprising in combination: the baseball bat having a knob end disposed at one end of the bat adjacent to a cylindrically shaped handle portion of the bat, the knob end having a socket hole, the practice device including a weight structure having a weight sized for positioning in coaxial engagement with the knob end of the baseball bat, the weight having a mass in the range of one to forty-eight ounces, the weight structure having connecting means projecting outwardly from the weight structure for disengageable connection within the socket hole to secure the practice device in fixed position with the knob end of the baseball bat for use in training, and actuation means operatively connected with the connecting means for controlling engagement of the connecting means with the socket hole, the actuation means including a lever adapted for movement by a user to a disengaging position to provide for disengagement of the connecting means with the socket hole.

* * * * *